US011844442B2

(12) United States Patent
Elmberg

(10) Patent No.: US 11,844,442 B2
(45) Date of Patent: Dec. 19, 2023

(54) BABY CARRIER

(71) Applicant: BABYBJÖRN AB, Solna (SE)

(72) Inventor: Lisen Elmberg, Stockholm (SE)

(73) Assignee: BABYBJÖRN AB, Solna (SE)

( * ) Notice: Subject to any disclaimer, the term of this patent is extended or adjusted under 35 U.S.C. 154(b) by 0 days.

(21) Appl. No.: 16/970,124

(22) PCT Filed: Jan. 22, 2019

(86) PCT No.: PCT/SE2019/050040

§ 371 (c)(1),
(2) Date: Aug. 14, 2020

(87) PCT Pub. No.: WO2019/164434

PCT Pub. Date: Aug. 29, 2019

(65) Prior Publication Data

US 2021/0059431 A1 Mar. 4, 2021

(30) Foreign Application Priority Data

Feb. 21, 2018 (SE) ..... 1850189-0

(51) Int. Cl.
*A47D 13/02* (2006.01)
*A45F 3/04* (2006.01)

(52) U.S. Cl.
CPC ..... *A47D 13/025* (2013.01); *A45F 3/047* (2013.01); *A41D 2400/482* (2013.01)

(58) Field of Classification Search
CPC .... A47D 13/025; A47D 15/006; A47D 13/02; A45F 3/047; A45F 3/04; A41D 2400/482; A44B 19/303; A44B 11/24; A44B 11/223; A44B 11/14; A44B 11/125; A44B 11/12; A44B 11/10; A44B 11/08; A44B 11/065; A44B 11/06; A44B 11/02
USPC ..... 224/158–160; 24/181, 171; 2/338, 319, 2/309–311
See application file for complete search history.

(56) References Cited

U.S. PATENT DOCUMENTS 3,332,120 A * 7/1967 Pigiel ..... A44B 11/10 24/171
4,009,808 A * 3/1977 Sharp ..... A47D 13/025 224/160
7,284,503 B2 * 10/2007 Elmberg ..... A47D 13/025 119/770

(Continued)

FOREIGN PATENT DOCUMENTS

JP 2006192221 7/2006
JP 2007105259 4/2007

*Primary Examiner* — Nathan J Newhouse
*Assistant Examiner* — Matthew T. Theis
(74) *Attorney, Agent, or Firm* — DUANE MORRIS, LLP; Gregory M. Lefkowitz; Randall C. Pyles

(57) ABSTRACT

The invention relates to a baby carrier comprising shoulder straps, which are arranged to extend around both shoulder regions of a wearer, and a front piece mounted on the shoulder straps so as to form a baby carrying pouch, and a head support, said front piece having a strip-like part connected to a lower portion of the shoulder straps via a coupling element, said strip-like part being movable lengthwise in the coupling element so as to adjust the size of the baby carrying pouch. A width W1 of the strip-like part is 50 to 150%, preferably 70 to 130%, and most preferably 90 to 110%, larger than a width W2 of the coupling element.

11 Claims, 3 Drawing Sheets

(56) References Cited

U.S. PATENT DOCUMENTS

| | | | | |
|---|---|---|---|---|
| 8,627,988 | B2 * | 1/2014 | Bergkvist | A47D 13/025 224/160 |
| 2002/0175194 | A1 * | 11/2002 | Norman | A47D 13/025 224/160 |
| 2006/0048722 | A1 | 3/2006 | Elmberg | |
| 2011/0186605 | A1 | 8/2011 | Favorito et al. | |
| 2013/0333113 | A1 | 12/2013 | Gotel | |
| 2014/0014692 | A1 | 1/2014 | Andren et al. | |
| 2016/0227940 | A1 | 8/2016 | Wikner | |

* cited by examiner

BABY CARRIER

CROSS-REFERENCE TO RELATED APPLICATIONS

This application is a § 371 national stage entry of International Application No. PCT/SE2019/050040, filed Jan. 22, 2019, which claims priority of Sweden National Application No. 1850189-0, filed Feb. 21, 2018, the entire contents of which are incorporated herein by reference.

FIELD OF THE INVENTION

The present invention relates to a baby carrier of the kind defined in the preamble of claim 1.

BACKGROUND OF THE INVENTION

A baby carrier of the above kind comprises a harness having shoulder straps arranged to extend around both shoulder regions of the wearer and a front piece, which together with the shoulder straps form a baby-carrying pouch, attached to the respective shoulder strap, preferably detachably attached to the respective shoulder strap.

A baby carrier of the above kind is known from SE 521 803 C2, for instance.

The front piece is made of a flexible material, which shapes itself to at least some extent under the influence of the shape and weight of the baby carried and has a lower strip-like part attached to the harness, preferably detachably attached to the harness, forming a seat support for the baby.

To increase the comfort of the baby/child carried by the baby carrier the seat support should have a certain width so as to reduce a possible pinch around at least part of the baby's legs, particularly around its thighs.

Moreover, the size of the baby-carrying pouch is adjusted by adjusting the length of said strip-like part relative to a coupling element connected to the harness, preferably detachably connected to the harness. This adjustment of said strip-like part must be firm to avoid unintentional adjustment, lengthening, of the strip-like part, i.e. avoiding increasing the size of the baby-carrying pouch and yet be continuous adjustable.

An object of the present invention is to provide a baby carrier having a front piece with an adjustable strip-like part/seat support that on the one hand increases the comfort of the baby/child carried and on the other hand provides a firm adjustment of the seat support.

According to the invention, this object is achieved by a baby carrier comprising shoulder straps, which are arranged to extend around both shoulder regions of a wearer, and a front piece mounted on the shoulder straps so as to form a baby carrying pouch therebetween, said front piece having a strip-like part connected to a lower portion of the shoulder straps via a coupling element, said strip-like part being movable lengthwise relative to the coupling element so as to adjust the size of the baby carrying pouch, characterized in that the width of the strip-like part is 50 to 150%, preferably 70 to 130%, and most preferably 90 to 110%, larger than the width of the coupling element.

The invention is defined in the accompanying independent claim.

Further embodiments of the invention will be apparent from the accompanying dependent claims.

BRIEF DESCRIPTION OF DRAWINGS

The invention will now be described in more detail by way of example with reference to the accompanying drawings, in which.

DESCRIPTION OF PREFERRED EMBODIMENTS

In the description and claims below it should be understood that the baby carrier is not limited to carry a baby and may equally be adapted to carry a child or a toddler. The expressions such as lower, front side, etc. should be read in relation to the normal use of the baby carrier.

Figure 1:
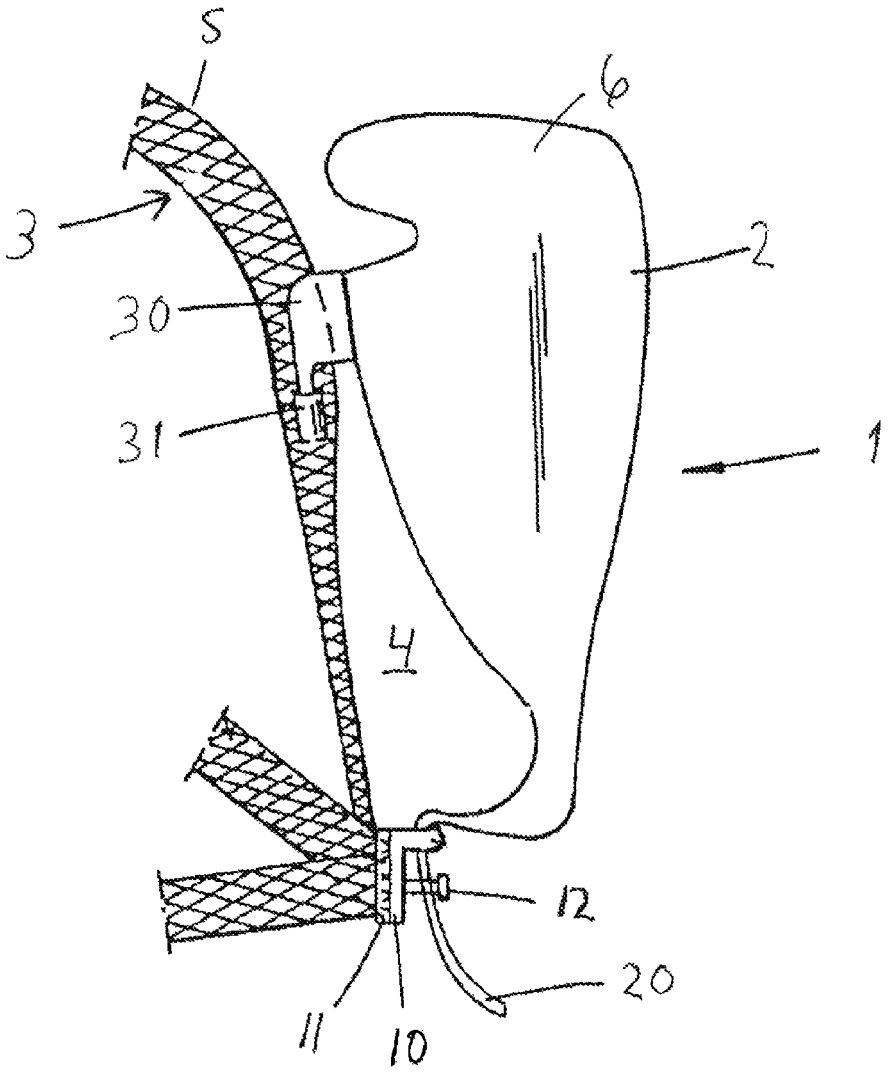
Fig. 1 Prior art
FIG. 1 is a schematic side view of a prior art baby carrier showing a part of the harness and the front piece.

FIG. 1 shows schematically a side view of a prior art baby carrier 1 comprising a front piece 2 which, together with a harness 3, forms a baby carrying pouch 4 on the front side of the harness 3.

The front piece 2 is thus supported by the harness 3, which includes two looped shoulder straps 5 that preferably are mutually coupled together by means of a fitting (not shown) on the rear side of the harness. The shoulder straps 5 carry at their lower parts situated on the front side of the wearer a coupling element 10 which includes an attachment means 11 for one end of an associated strap loop and includes a transit opening for the other end part of said loop. Respective attachment means 11 can thus be considered to form on the front side of the harness the end portions of a waist belt that includes horizontal harness parts that connect between the two elements 11.

The front piece 2 has a lower strip-like part 20 that can move lengthwise through at least one, preferably two, eyelet (s) 13 formed in the coupling element 10 together with a moveable pin 12, which together with the base of the coupling element 10 prevents movement of said strip-like part 20 relative to the coupling element. The strip-like part 20 is thus threaded through said at least on eyelet 13 and is continuously adjustable therein. The effective length of the strip-like part 20 determines the length of the front piece 2 in a vertical direction and thus also the depth/size of the baby carrying pouch 4.

It is obvious to the man skilled in the art that the effective length of the strip-like part 20 may be adjusted by other types of coupling elements. The strip-like part 20 can be pinched by an openable arm to the coupling element, for instance. In such case the effective length of the strip-like 20 is gradually adjustable.

The coupling element 10 can be connected releasably to respective sides of the attachment means 11.

The front piece 2 has at respective upper side portions a coupling element 30 for releasable connection with a corresponding coupling element 31 on the shoulder strap 5 on the front side of the harness 3. Each shoulder straps 5 may include a length adjustment fitting (not shown) for changing the size of respective strap loop.

Moreover, the front piece 2 comprises also a head support 6 which has at respective upper side portions a coupling element 40 (see FIGS. 2 and 3) for releasable connection with a corresponding coupling element (not shown in FIG. 1) on the shoulder strap 5 on the front side of the harness 3.

Figure 2:
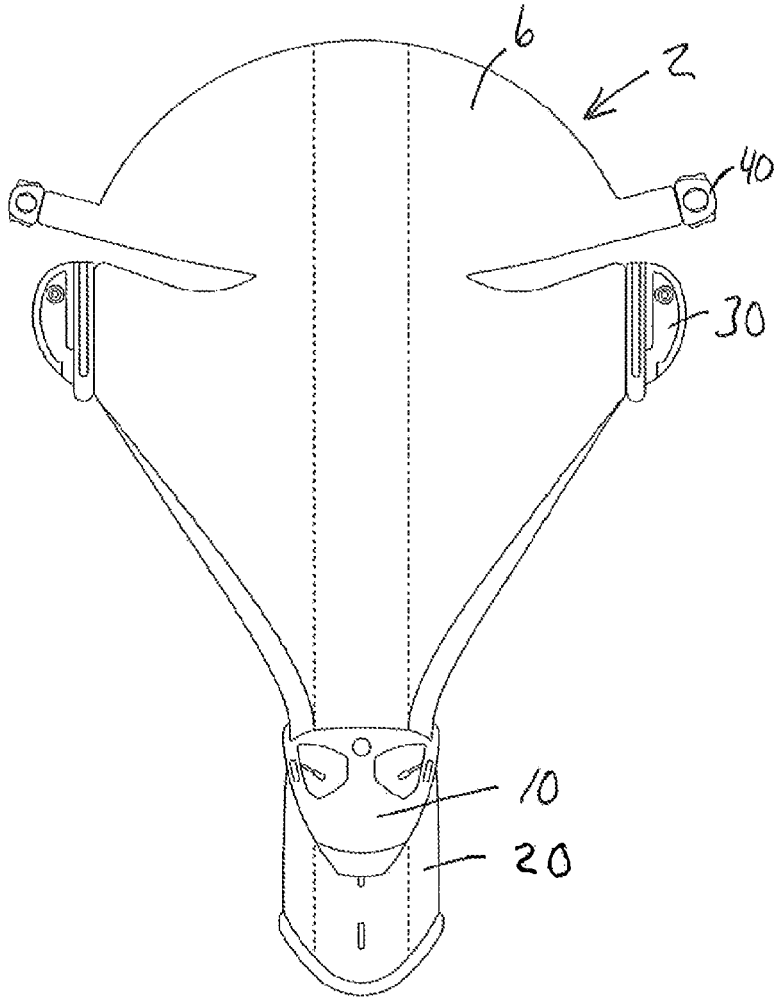
Fig. 2 Prior art
FIG. 2 is a view of the inside of a prior art front piece intended to be attached to the harness shown in FIG. 1.

As seen in FIG. 2 the front piece 2 can be considered to be formed by a generally flat piece of material having at its lower end the strip-like part 20 that is received in and can be displaced longitudinally relative to the coupling element 10. The strip-like part 20 forms a seat support. The strip-like part 20 has a width that corresponds to or is less than the width to the coupling element 10 and has preferably a width corresponding to the width of the eyelets 13 of the coupling element 10.

Figure 3:
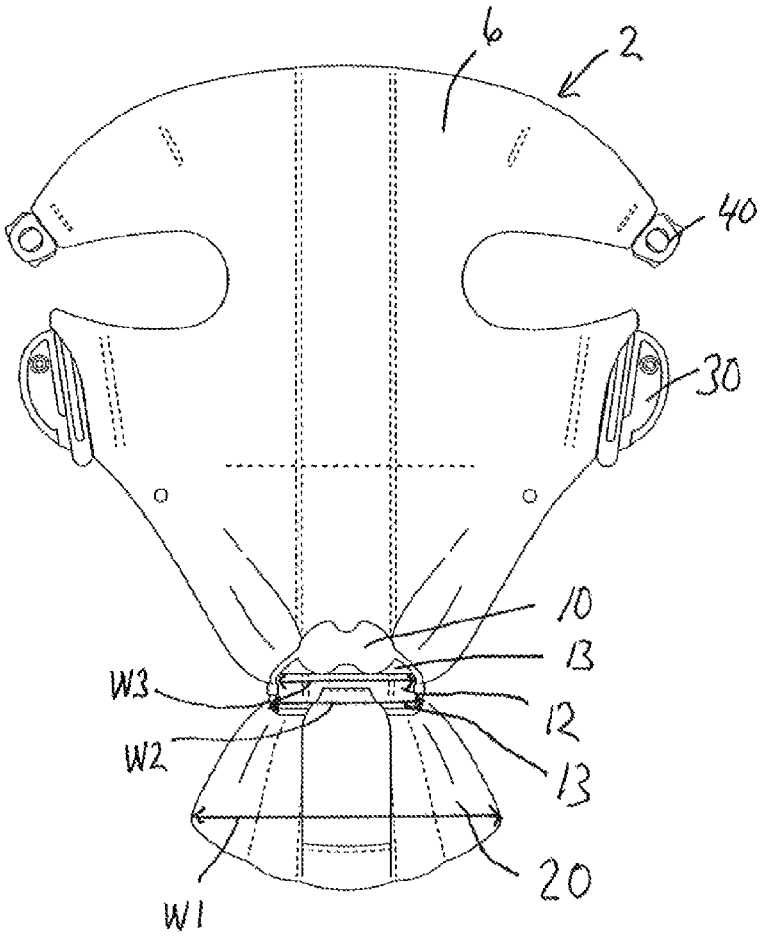
FIG. 3 is a view of the inside of a front piece according to the invention.

FIG. 3 shows a front piece 2 according to the invention. As can be inferred the strip-like part 20 forming the seat support for the baby has a width W1 which is much larger than the width W2 of the coupling element 10. More particular, a width W1 which is much larger than the width W3 of the at least one eyelet 13 of the coupling element 10. More particular, the width W1 of the strip-like part 20 is 50 to 150%, preferably 70 to 130%, and most preferably 90 to 110%, larger than the width W2 of the coupling element 10.

In the form of a non-limiting example the external width W2 of the coupling element 10 is about 10 cm and the width W1 of the strip-like part 20 is about 17 cm in case the material of the front piece is cotton, about 20 cm in case the material of the front piece is mesh, and about 22 cm in case the material of the front piece is jersey.

By making the strip-like part 20 wider than the coupling element 10 the portion loaded by the baby of strip-like part 20 will be slightly bowl shaped due to that the material will fold around the coupling element. This means that the seat support formed by the strip-like part 20 will be somewhat rounded and will shape itself after the baby.

Moreover, in case the coupling element 10 is provided with at least one eyelet 13 the thickness of the material forming the strip-like part 20 can be made thinner, yet the clamping effect of strip-like part 20 within coupling element 10 can be improved, since more material of the strip-like part 20 is placed within the at least one eyelet 13.

Thus, it is possible to increase the width of the seat support/strip-like part 20 without increasing the width of the coupling element 10, which is made of a stiff material, such as a plastic material. Thus, the extra material formed around the coupling element 10 forms a cushioning effect and reduce the possible discomfort felt by the baby sitting on the stiff coupling element 10.

The invention claimed is:

1. A baby carrier comprising:

shoulder straps, which are arranged to extend around both shoulder regions of a wearer, a front piece mounted on the shoulder straps to define a baby carrying pouch therebetween, said front piece having a strip-like part connected to a lower portion of the shoulder straps via a coupling element, said strip-like part being movable lengthwise relative to the coupling element so as to adjust a size of the baby carrying pouch, and a moveable pin to continuously lengthwise adjust the strip-like part together with a base of the coupling element, wherein the coupling element includes at least one eyelet through which the strip-like part is threaded to continuously lengthwise adjust the strip-like part, a width W1 of the strip-like part adapted to be continuously threaded through the eyelet to continuously lengthwise adjust the strip-like part is 50 to 150% larger than a width W2 of the coupling element, and the moveable pin retains the strip-like part by a clamping effect directly between the moveable pin and the base of the coupling element.

2. The baby carrier according to claim 1, wherein the coupling element comprises two eyelets.

3. The baby carrier according to claim 1, wherein the coupling element is detachably connected to the shoulder straps.

4. The baby carrier according to claim 1, wherein the front piece is made of a material selected from the group consisting of cotton mesh, and jersey.

5. The baby carrier according to claim 1, wherein a width W1 of the strip-like part is 70 to 130% larger than a width W2 of the coupling element.

6. The baby carrier according to claim 1, wherein a width W1 of the strip-like part is 90 to 110% larger than a width W2 of the coupling element.

7. The baby carrier according to claim 1, wherein the moveable pin extends at least a width W3 of the at least one eyelet.

8. The baby carrier according to claim 2, wherein the moveable pin retains the strip-like part between the two eyelets.

9. The baby carrier according to claim 1, wherein the moveable pin retains the strip-like part by a clamping effect between the moveable pin and the coupling element.

10. The baby carrier according to claim 1, wherein the moveable pin retains the strip-like part together with a base of the coupling element.

11. The baby carrier according to claim 10, wherein the moveable pin retains the strip-like part between the movable pin and a base of the coupling element.

* * * * *